US005562056A

United States Patent [19]

Christman, Jr.

[11] Patent Number: 5,562,056

[45] Date of Patent: Oct. 8, 1996

[54] TUFTING MACHINE WITH PRECISION REMOTELY ADJUSTABLE BEDRAIL ASSEMBLY AND PROCESS OF CONTROLLING THE PILE HEIGHTS OF TUFTS TO BE PRODUCED ON A TUFTING MACHINE

[75] Inventor: William M. Christman, Jr., Hixson, Tenn.

[73] Assignee: Card-Monroe Corp., Chattanooga, Tenn.

[21] Appl. No.: 313,467

[22] Filed: Sep. 27, 1994

[51] Int. Cl.[6] ..... D05C 15/14

[52] U.S. Cl. ..... 112/80.33; 112/80.42

[58] Field of Search ..... 112/80.01, 80.23, 112/80.3, 80.33, 80.42, 80.7, 80.72, 80.73, 266.2, 475.23

[56] References Cited

U.S. PATENT DOCUMENTS 3,332,379 7/1967 Cobble, Sr. et al. ..... 112/80.33

3,881,432 5/1975 Dodd et al. .

4,867,080 9/1989 Taylor ..... 112/80.32

OTHER PUBLICATIONS

IEEE Standard Dictionary of Electrical and Electronics Terms, pp. 373 and 374, May. 1978.

*Primary Examiner*—Paul C. Lewis

*Attorney, Agent, or Firm*—Hopkins & Thomas

[57] ABSTRACT

A tufting machine has a bedrail which is raised and lowered by a motor controlled by a computer. The computer also controls the yarn feed motor and the backing material motor. A sensor detects the height of the bedrail and provides a feedback to the computer. In a process of raising the bedrail alternately a prescribed excess of yarns are fed to the needles as the machine is operated and then the bedrail is raised by an increment of the total amount by which the bedrail is raised. Brakes automatically operate to arrest movement of the bedrail when its motor is not operating.

24 Claims, 2 Drawing Sheets

TUFTING MACHINE WITH PRECISION REMOTELY ADJUSTABLE BEDRAIL ASSEMBLY AND PROCESS OF CONTROLLING THE PILE HEIGHTS OF TUFTS TO BE PRODUCED ON A TUFTING MACHINE

FIELD OF INVENTION

This invention relates to a tufting machine, and is more particularly concerned with a tufting machine with a precision, remotely adjustable, bedrail assembly and to a process of controlling the pile height of the tufts to be produced on a tufting machine.

BACKGROUND OF THE INVENTION

In the past, various ways have been utilized for changing the pile height of the tufts of the tufting machine. Usually to change the stroke of the needle bar is quite time consuming and entails a shut down of the machine.

Another way of changing the pile height of the tufts sewn into the backing material is through the control of the yarn feed of the tufting machine so as to rob yarn from the previously sewn loop as the needles descends through the backing material.

Still other methods of controlling the pile height of tufts formed in a backing material has been to provide screw jacks which can be manipulated to raise and lower the bedrail. U.S. Pat. No. 3,881,432 granted to Dodd, et al., discloses such an adjustable bedrail supported by a plurality of screw jacks which are simultaneously rotated manually or by power. Such a procedure is quite imprecise and time consuming.

In the prior art, the hydraulic clamps or brakes have been manually operated. In doing so, the operator would look at a dial indicator which was mounted above the bedrail. The operator would then turn a rack and gear setup handwheel such that the bedrail would be raised and lowered. The serious disadvantage with that prior art system independently was that the loading and unloading of that system would account for 0.010 to 0.050 inch of error. So for the operator to get to an accurate position for the bedrail, he would actually have to lower the bedrail about a 0.1 inch below where he needs to go and then change direction and go back up to the location that he needs. In changing the bedrail position in a cut pile operation of the prior art machine, what the operator would have to do is very time consuming in that he would actually have to jog the machine to get the loops off the loopers. He would then have to raise the bedrail a small amount, whether it be a 0.1 inch or 0.2 inch—whatever he could physically pull the bedrail up to, before he felt the yarn tension was too tight. At that point he would then increase the yarn feed rate, whether that meant changing V-belt ratios on the end of the machine or by changing the amount yarn feed, whichever system, he would have to effect an increase in yarn feed. He would then have to stop the process again and manually unclamp the brakes and raise the bedrail again. So, for a ½ inch height change, he might have a 15 minute operation. His margin of error in the prior art method was very imprecise because his dial indicator is most often just a measure of how far he's moved relative to this one time. So, there has never been an absolute position on the bedrail in the past. In other words, using the prior art system, if the pile height needed increasing about 0.2 inch, the operator would know he needs to move the bedrail about 0.2 inch up. There would be no actual set position for the bedrail so that he could return to the same setting, in the future. If an operator wanted to come back and run this exact set up a month later, he would not have an accurate way of doing this.

In the prior art, clamp hydraulic cylinders 46 were controlled by a mechanical pump and the operator actually turned a handwheel which actually operated the pump. In other words, the operator would actually pump the pressure into the hydraulic system by hand.

U.S. Pat. No. 4,867,080 granted to Brooks E. Taylor, et al. discloses a computer controlled tufting machine providing a bedrail height adjustment which utilizes a stepping motor for raising and lowering the bedrail. This stepping motor, in turn, is controlled by the computer. This form of structure will enable the remote controlling of the motor which actuates the screw jacks to raise and lower the bedrail. Problems, however, exist in making certain that the bedrail is disposed at a precise height in the tufting machine as dictated by the computer. The screw jacks, for example, sometimes become rusted and worn so as to locate the bedrail at only the approximate desired location and the stepping motor may rotate after being shut down, due to the vibrations.

SUMMARY OF THE INVENTION

Briefly described the present invention employs a stepping motor (sometimes referred to as stepper motor) for raising and lowering the bedrail of a tufting machine, as dictated by a computer, wherein the bedrail, itself, actuates a linear transducer so as to provide a feedback signal to the computer which indicates the precise height of the bedrail with respect to the bed plate on the frame of the tufting machine. Signals from the computer control the actuation of the stepping motor and, when the precise height at which the bedrail is detected from the feed back, the computer signals will cause the stepping motor to stop and the brakes for the bedrail to be engaged.

The computer is preferably programmed so that when the bedrail is raised, it is raised incrementally and between successive increments, an excess amount of yarns are fed to the needles in order to prevent the loops, accumulated on the bills of the cut pile loopers, from breaking the loopers. Such a program is recommended even for loop pile tufting machines, since they, later, may be converted to cut pile machines.

Accordingly, it is an object of the present invention to provide a tufting machine in which the level of the upper surface of the bedrail can be readily adjusted to a precise prescribed position.

Another object of the present invention is to provide in a tufting machine, an adjustable bedrail assembly which provides precise control of the bedrail from a remote location.

Another object of the present invention is to provide a method of adjusting the height of a bedrail of a tufting machine so that the bedrail can be readily and easily relocated, from time to time, to different precise prescribed heights.

Another object of the present invention is to provide a tufting machine in which the pile height of the tufts being produced may be readily and easily altered.

Another object of the present invention is to provide a tufting machine and a method of changing the pile height of successive styles of carpet wherein such change can be automatically controlled.

Another object of the present invention is to provide for a tufting machine, a process and apparatus which will change the pile height of a successive style carpet being produced, while conserving yarn and backing material when converting from one style of carpet to another.

Another object of the present invention is to provide a tufting machine in which the danger of breaking loopers when the height of a bedrail is raised, automatically, will be reduced to a minimum.

Another object of the present invention is to provide for a tufting machine, a system and process for precisely changing and maintaining successive prescribed heights for the bedrail of the machine.

Another object of the present invention is to provide for a tufting machined a system and process by which parameters for successive styles of carpeting using different level pile heights can be stored in a computer and accurately and automatically used by the tufting machine, according to the dictates of a program.

Another object of the present invention is to provide a tufting machine capable of accurately and uniformly producing and reproducing successive different styles of carpet with accurate prescribed densities of face yarn.

Another object of the present invention is to produce a tufting machine capable of storing in memory various styles of carpets with different parameters, including a pile height, each style being capable of being produced and reproduced readily in prescribed successive lengths of such carpet, without the necessity of shutting down the machine for change in pile height and without the necessity of having to sew sample quantities of goods for testing before each run of that style is commenced.

Another object of the present invention is to provide a tufting machine capable of producing successive patterns or styles of carpeting having differing pile heights in a quick, facile manner with a minimum of fabric and yarn loss due to style changes.

Another object of the present invention is to provide a tufting machine having a mechanism for altering the height of a bedrail and which is inexpensive to manufacture, durable in structure and efficient in operation.

Other objects, features and advantages of the present invention will become apparent from the following description and considered in conjunction with the accompanying drawings wherein like characters of reference designate corresponding parts through the several views.

DETAILED DESCRIPTION

Figure 1:
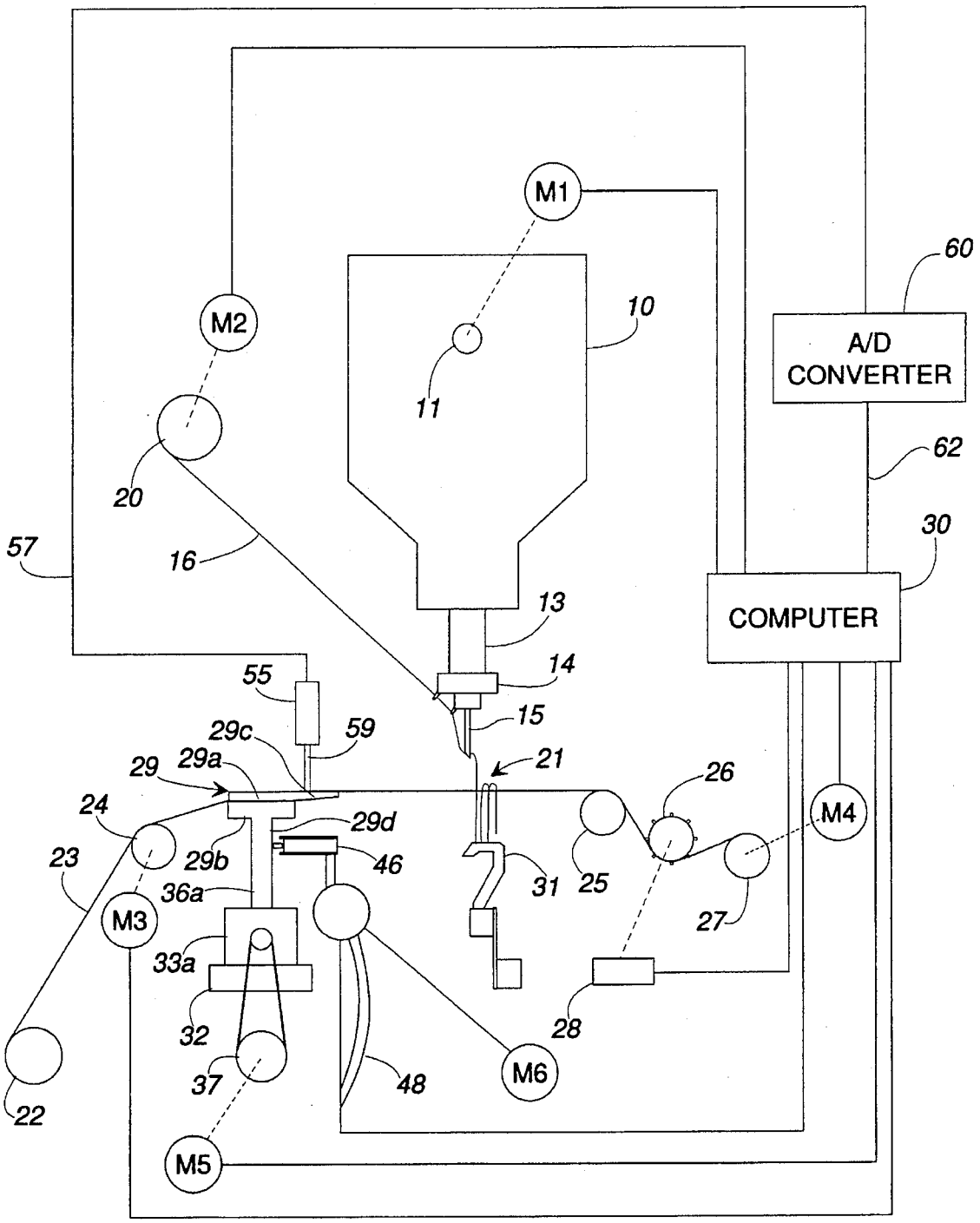
FIG. 1 is a schematic diagram of the tufting machine constructed in accordance with the present invention.

Referring now in detail to the embodiment chosen for the purpose of illustrating the present invention, numeral 10 denotes generally the frame of a conventional cut pile tufting machine which includes a conventional main drive shaft 11 driven by motor M1. The shaft 11 reciprocates a plurality of push rods 13 which reciprocate a needle bar 14, carrying a plurality of needles 15 aligned transversely of the feed of the backing material 23. Yarns 16 are supplied to the tufting machine from a yarn feed mechanism or a yarn control, and thence to the respective needles 15. The yarn feed mechanism includes, for example, transversely disposed rollers or rolls, such as roll 20, over which the yarns 16 pass and then extend downwardly to the needles 15. It will be understood that any of a number of different yarn feed mechanisms can be employed, as is well known to those skilled in the art. Roll 20 is driven by a synchronous motor M2.

The base fabric or backing material 23 is fed in from a roll of backing material 22 up over a front feed roll 24, passing, in a linear, generally horizontal path across the machine, over the idler roll 25, thence under a pin roll 26 and then over a rear or output drive roll or discharge roll 27. Roll 24 is driven by synchronous motor M3 and roll 27 is driven by synchronous motor M4. A computer 30 synchronizes and controls the rolls 24 and 27, synchronizing them so as to rotate the rear roll 27 at a slightly faster speed than the rotation of front roll 24 to thereby assure that the backing material 23 is in a taunt condition when passing over the bedrail 29 and beneath needles 15 in a tufting zone denoted generally by numeral 21. The pin roll 26 is an idler roll which has an encoder 28 which generates an interrupt signal fed to computer 30 for each rotation. The interrupt signal generated by the encoder 28 causes the incrementing of a counter (not shown) which indicates to computer 30, the length of carpet produced.

Motors M2, M3 and M4 are synchronous motors, each communicating with and being controlled as to rotation and the distance of the rotation, by computer 30.

The motor M4, at one side on frame 10, drives and controls the rear feed roller 27. The feed rolls 24 and 27 are driven in synchronization with each other to pass the backing material 23 across the bedrail 29 and beneath the needles 15 for stitching action in a tufting zone 21 by needles 15.

Below the backing material 23 in the tufting zone 21 are the loopers, which, in the embodiment depicted in FIG. 1 are cut pile loopers 31. These cut pile loopers 31 function in the usual way to catch the loops of yarns being sewn by the needles 15 through the backing material 23. While I have illustrated the machine of FIG. 1 to be a cut pile tufting machine, it will be obvious to those skilled in the art that by changing the loopers 31 and the direction of facing the loopers, the tufting machine can be converted to a loop pile machine. The structure thus far described is found in U.S. Pat. No. 4,867,080.

According to the present invention, the tufting machine of the present invention is provided with a bedrail assembly, in which the bedrail 29 is T-shaped in cross-section and extends transversely across the frame 10 and transversely beneath the entire width of the backing material 23. The upper surface **29*a* of the head 29*b* of bedrail 29 is preferably a flat horizontally disposed surface, against which the bottom surface of the backing material 23 slides as it passes across the tufting machine. Reed fingers 29*c* may extend from the side of this head 29*b* toward the tufting zone 21, as illustrated in FIG. 1**.

The supporting base **29*d* of the bedrail 29 is integrally formed with the head 29*b* and provides a central upstanding support for the rectangular, horizontally disposed head 29*b*. Both the base 29*d* and the head 29*b* are essentially rectangular members, the upper edge of the base 29*d* being integrally joined to the central longitudinal portion of the lower surface of head 29*b***.

Disposed vertically below the bedrail 29 is a base rail 32 which forms a fixed part of the frame 10 of the tufting machine. On the upper surface of the base rail 32 are a plurality of equally spaced, horizontally aligned, right angle ball screw jacks 33*a*, 33*b* and the drive shafts 34*a*, 34*b*, protruding from their housings 35*a*, 35*b*. Housings 35*a*, 35*b* are aligned transversely of the machine so as to be vertically below the base 29*d* of the bedrail 29. These ball screw lacks 33*a*, 33*b* include upstanding extendable, externally helically threaded, lift shafts 36*a*, 36*b*.

A stepping motor M5 provided with a pulley 37 drives a timing belt 38, mounted on frame 10 and received around a pulley 39 mounted on the end of a drive shaft 40 which is axially aligned with the respective drive shafts 34*a*, 34*b* of the respective jacks 33*a*, 33*b*.

The lift shafts 36*a*, 36*b* are raised and lowered when the shaft 40*b* is rotated in one direction or the other. The lift shafts 36*a*, 36*b* engage the lower edge of the base 29*d* at spaced locations and thus simultaneously extend or retract as the stepping motor M5 is rotated in one direction or the other. Shaft 40 is provided at its end with a coupling 41 which, in turns is connected to one end of the shaft 34*a*, seen in FIG. 3. The other end of the shaft 34*a* is connected through a coupling 41*a* to a transfer shaft 42 which is connected through a coupling 41*b* to the shaft 34*b* of the next adjacent jack 33*b*, etc. Thus, there are provided a series of spaced horizontally aligned jacks mounted on the base plate 32 each having spaced parallel lift shafts, immediately beneath the bedrail 29. Hence, upon rotation of motor M5, the shafts 40, 34*a*, 34*b* are simultaneously rotated so as to actuate the spaced, upright, lift shaft 36*a*, 36*b* of each jack, simultaneously. Thus, the motor M5, which can be rotated in one direction or the other, to raise or lower the bedrail 29, depending upon the rotation of motor M5.

Positioned adjacent to the base 29*d* of the bedrail 29, are a plurality of transversely spaced hydraulic brakes, such as brake 46 seen in FIG. 1 mounted on frame 10. These hydraulic brakes, such as brake 46, are controlled by a fluid motor M6, which, in turn, is controlled from computer 30. Fluid is withdrawn from the brakes 46, whenever the computer dictates that the motor M5 is operating to change the height of bedrail 29. Thus, brakes, such as brake 46, are normally engaged to arrest the movement of the bedrail 29, whenever motor M5 is not changing the position of the bedrail 29.

Figure 2:
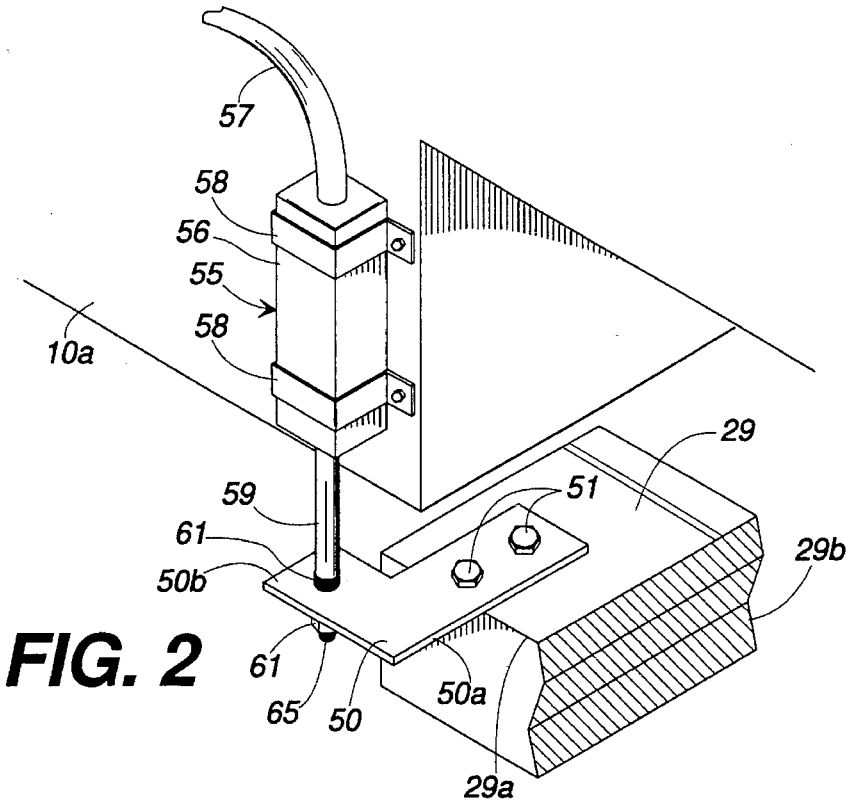
FIG. 2 is an enlarged perspective view of a portion of the tufting machine depicted in FIG. 1 showing primarily the linear transducer and end of the bedrail therein.
Figure 3:
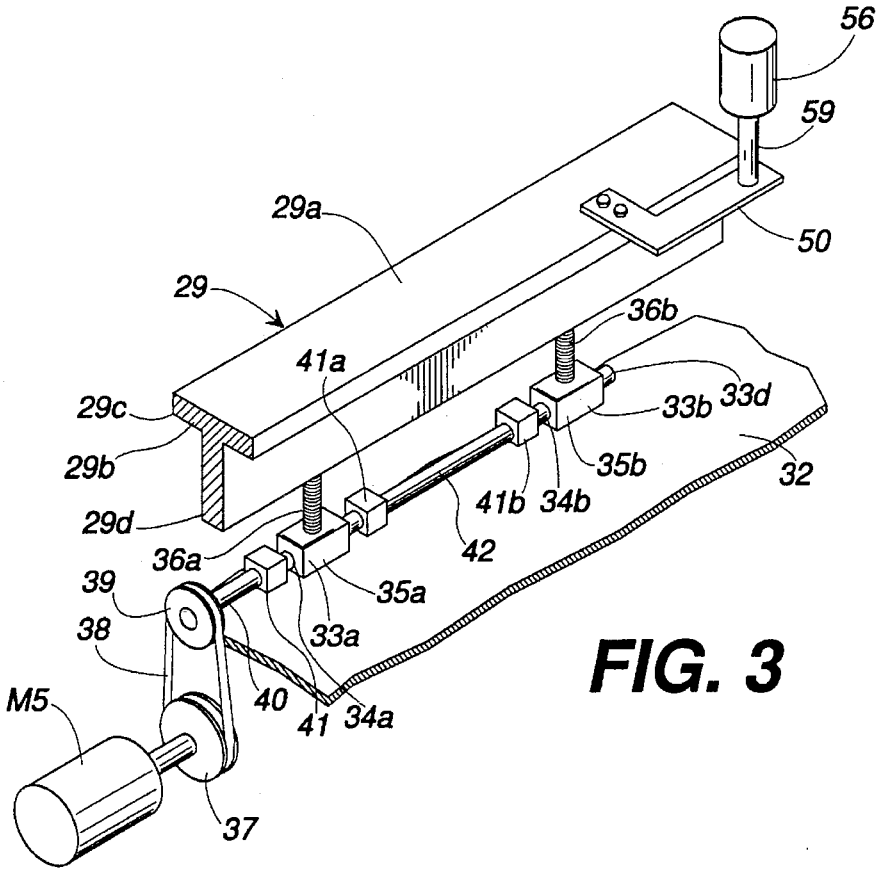
FIG. 3 is a perspective view of a portion of the tufting machine depicted in FIG. 1 showing schematically the bedrail assembly thereof.

In FIGS. 2 and 3, it is seen that at one end portion of the bedrail 29 is provided a flat, rigid, L-shaped bracket 50, one leg 50*a* of which is fixedly secured to the surface 29*a* of the bedrail 29, by means of bolts 51, thereby permitting the apex of the bracket 50 to protrude beyond the longitudinal edge of the bedrail 29 and support the other arm 50*b* in a fixed position protruding parallel to and spaced from the edge of bedrail 29.

A sensor, preferably a linear transducers denoted by the numeral 55, is disposed for sensing the location of the bracket 50 and, hence, the position of the upper surface 29*a* of the head 29*b* of the bedrail 29. In more details this sensor or linear transducer 55, is of the type manufactured by Waters Manufacturing, of Whaleland, Mass. This transducer 55 includes an electrical sensing element 56, functions as a potentiometer, which is electrically connected by cables 57 which leads to an analog-to-digital converter 60 which is electrically connected to computer 30. The element 56 is clamped in an upright position onto the wall 10*a* of the frame 10, by means of a pair of straps 58, seen best in FIG. 2. The linear transducer 55 is mounted in a vertical position so that its straight, vertically movable rod 59 protrudes vertically downwardly from the lower end of element 56, through an opening in the arm 50*b* of the bracket 50. The lower end portion of the transducer rod 59 is provided with external threads 65 which receive a pair of nuts, one nut 61 being above the bracket arm 50*b* and the other nut 61 being below the bracket arm 50*b* so as to permit vertical adjustment of the rod 59 for zeroing the transducer or potentiometer 55.

Cables 62 lead from converter 60 to the computer 30 so that the computer 30 can detect the exact height of the upper surface 29*a* of the bedrail 29.

The computer operation monitors the location of the bedrail 29, itself, by measuring the height of the top surface 29*a* of the bedrail 29, above the height of the bed plate 32 on which its rests. This difference in height is then measured by a linear transducer 55, the resistance of element 56 of which is then analyzed by computer 30. This height is analyzed by the computer 30 through an analog digital converter 60 which converts the measurement to within 0.001 of an inch in accuracy. What this allows is a pattern or style changeover to be made by signals from computer 30 to provide tuft heights within 0.001 inch, regardless of what mechanism is used to move the bedrail 29. For instance, the jacks 33*a*, 33*b* may have a backlash in them, the stepper motor M5 will have a small loading or unloading backlash when it is enabled or disabled. All of these motions will add up to an error. By measuring the bedrail 29 location, itself, instead of the number of revolutions that the bedrail motor M5 or jacks 33*a*, 33*b* are turning, will allow the system to be accurate, regardless of all the other errors. What this does is allows the operator or computer 30 to position the bedrail 29 to any specific location automatically, given by a digital number on the computer 30, which is represented in 0.001 of an inch.

The computer 30 determines from between the current position of the bedrail 29, the height to which the bedrail 29 is to go. For instance, if the bedrail 29 is positioned at 1 inch and the operator or a program wants to go down ½ inch, then, by an appropriate setting of the computer 30, it will instruct the stepping motor M5 to rotate in the prescribed direction, the appropriate circular distance which relates to ½ inch. The computer 30 then verifies this motion with readings back from the linear transducer 55, thereby verifying that the actual full ½ inch change was accurately made. If it were not made, the computer 30 would basically send signals to motor M5 to home in on the error window of the desired location that was requested by the operator or program in computer 30. Motor M5 thus moves the bedrail 29 up or down to the position that the operator or program requested.

If the request is for a position of the bedrail 29, higher than where the bedrail 29 current height is set, the computer 30 will sequence this into a series of cycles or steps which involve moving the bedrail 29 up a maximum of 0.1 inch at a time. After it moves the bedrail up 0.1 inch, then motor M5 will stop. The computer 30 then dictates to motor M2 to increase the feed rate of yarn 16 by the appropriate amounts to compensate for the tighter pull which will be generated by raising the bedrail 29. This increase in yarn feed of yarns 16 dictated for a minimum of five successive penetrations of needles 15, thereby jogging, starting and stopping the machine for five times at a minimum. In each cycle of the machine, it would stop, unclamp the bedrail 29, raise the bedrail 29 another 0.1 inch, reclamp it, and recalculate a new yarn feed increase amount. This sequence of events would continue in sequence until the bedrail 29 is within the error window of its desired location.

The piston of hydraulic brake or clamp 46 is withdrawn by controlling electric motor M6 which drives the hydraulic pump P, which is directly in the hydraulic line 48 with the cylinders of brake 46. There is enough freedom in motion in the pistons of the clamps or brake 46 that, once you get a pressure below about 200 to 300 psi, the bedrail 29 is able to move up and down freely, although actually hydraulic pressure is not totally withdrawn. The normal pressure on each piston or the clamp 46 ranges anywhere from 2,000 psi to 2,500 psi. There are usually several clamps or brakes 46 positioned at spaced distances based on the width of the machine so that these pistons simultaneously clamp against the vertical side of the bedrail 29.

The bed plate 32 is a part of the main frame 10 and is usually attached to the legs of the frame. It is always stationary in reference to the ground floor.

Bedrail 29, however, is movable vertically up and down, its position determining pile height. What is measured by the sensor 55 is the difference of the bedrail and the height of the bed plate 32. Other methods of feedback on the bedrail itself can be used in the present invention. For example, a laser depth indicator, could be substituted to determine an exact distance or displacement. So, in other words, you could measure the bedrail indirectly by knowing where one of your end points of travel is and how many steps relative to the end point the bedrail has moved.

It is important in using the process of the present invention to alternate between sewing with an excess of yarns and incrementally changing the bedrail position preferably so as to get the shorter loops off the loopers 0.1 inch at a time between each 0.1 inch, movement of the bedrail 29. In each cycle, the machine only moves in the range of 5–7 penetrations of needles 15. What that relates to is about ½ inch of carpet output per 0.1 inch of bedrail 29 travel.

If you have a drastic change which might be, for example, ½ inch of pile height, that would relate to only about 25–30 stitches or penetrations on the machine which is less than 3 inches of carpet for a complete pattern change from a very low pile height to a very high pile height in 3 inches of backing material 23.

If this had to be done by hand, mechanically, the time would be greatly increased and the amount of yarn would be greatly increased and the bedrail position would not be very accurate because you would only be within 0.050 of an inch in accuracy. You would actually have to tune the bedrail in as you ran the machine. For example, the operator might run 10, 50 or 100 feet and the face of the carpet might appear to be rough or might not look right so the operator might have to manipulate the bedrail. He might have to raise the bedrail another 0.10 or 0.20 inch to try to increase the look of the fabric. However, with the present invention, once you get the look that you want, you store the numerical word in location in the computer 30 and you can come back to the same look exactly, every single time. The height of bedrail 29, indeed, is a very critical point in how perfect the carpet face looks.

In operation, the start of the cycle is determined by measuring the resistance of the linear transducer element 55. To do so, the computer 30 reads through an analog digital converter 60, the digital equivalent of where the rod 59 of linear transducer 55 is positioned. The computer 30 then records this information as the current position of the bedrail 29. The computer 30 then compares the current position of the bedrail 29 to the desired position of the bedrail 29, which is what the operator has entered into the system.

If the computer 30 determines that the desired location, which is set by a program or by the operator in the computer 30, is lower than the current position of the bedrail 29, the computer 30 will then immediately move the bedrail 29 to that desired position because it knows that there is no risk of damaging the loopers since the backing material is moving closer to the loopers and the loops are relaxing, not stretching them. However, if that distance is increased or if the backing material 23 is moving to a position above where it is currently located, the computer 30 will then feed enough yarn 16 to cover twice the distance that the backing material is to move over that period of time. If the bedrail 29 were going to be moved 0.5 inch above where it is currently at, the bedrail is at 0.5 inch, the computer 30 will calculate the yarn feed for 0.5 inch change in pile height which is approximately 1 inch initially, and computer 30 knows the current yard feed for where the bedrail 29 is and knows then that the next desired intermediate position of the bedrail 29 would be 0.6 inch. For the bedrail 29 to be able to move to 0.6 inch, the computer 30 dictates to the motor M2 that an extra 0.2 inch of yarn be fed by roll 20 to compensate for both the up stroke and the down stroke of the needles 15 around the loopers 21. These extra lengths accumulate as progressively increased pile heights from a height of 0.5 inch to 1 inch. This produces a gradual increase in pile height over a very short distance on the backing material.

Preferably, the feed of progressively increasing amounts of yarn should be incorporated into the program of computer 30, because of the potential of changing gauges or setups on the machine might cause a lifting of the bedrail 29. So even loop pile machines should be programmed for incrementally feeding increased amounts of yarns as the bedrail is lifted, even though it is not a requirement. Later, such a machine might be converted from a loop pile to a cut pile machine which, when used, might damage the machine by raising the bedrail 29 without automatically feeding increased amounts of yarn in between increments of lifting the bedrail 29.

It will be obvious to those skilled in the art that many variations may be made in the embodiment here chosen for the purpose of illustrating the present invention, without departing from the scope thereof as defined by the appended claims, read in conjunction with the accompanying drawings.

I claim:

1. A tufting machine having a frame, a main drive shaft on said frame for reciprocating a needle bar carrying a plurality of transversely disbursed needles for successively inserting yarns carried by said needles in successive transverse portions through a backing material as the backing material is fed along a longitudinal path by tufting action of said needles in a tufting zone, and loopers on the other side of said backing material for catching said loops in said tufting zone and temporarily holding them, so that successive tufts of a prescribed pile height are produced in said backing material as said needles are reciprocated, the improvement comprising:

(a) a transversely disposed bedrail on said frame and over which said backing material is fed for establishing the pile height for said tufts produced in said backing material, said bedrail being movable in said frame along a prescribed path of movement for changing the position of a transverse portion of said backing material with respect to said needles for thereby changing the pile height for tufts thereafter sewn by said needles in said backing material;

(b) a reversible motor mounted on said frame;

(c) a drive train between said motor and said bedrail, by which said bedrail is moved along its prescribed path, in one direction or the other for moving a portion of said backing material in said tufting zone toward said needles upon rotation of said motor in one direction, and for moving said portion of said backing material away from said needles upon rotation of said motor in the other direction;

(d) a sensor having one end portion connected to said bedrail for progressively detecting the positions of said bedrail in said path of movement, an output of said sensor varying with a position of said one end portion; and (e) control means responsive to said sensor for controlling the direction and extent to which said motor moves said bedrail.

2. The tufting machine defined in claim 1 wherein said bedrail is T-shaped, providing an upper surface and a base disposed therebelow, said drive train including a plurality of spaced screw jacks driven by said reversible motor.

3. The tufting machine defined in claim 2 including a base plate secured to said frame for supporting said screw jacks in a prescribed position with respect to said frame.

4. The tufting machine defined in claim 3 including a pulley on said reversible motor, a pulley for driving said screw jacks simultaneously and a belt extending between the pulley on said motor and the pulley for driving said screw jacks.

5. The tufting machine defined in claim 1 wherein said sensor is a linear transducer for detecting the height of said bedrail.

6. The tufting machine defined in claim 1 wherein said control means includes a computer for dictating to said motor the extent to which said motor is to change the position of said bedrail.

7. The tufting machine defined in claim 6 including a bracket rigidly mounted on one end portion of said bedrail and connected to said one end portion of said rod.

8. The tufting machine defined in claim 7 wherein said rod protrudes through said bracket and means on said rod for adjusting the rod with respect to said bracket.

9. A tufting machine having a frame, a main drive shaft on said frame for reciprocating a needle bar carrying a plurality of transversely disbursed needles for successively inserting yarns carried by said needles in successive transverse portions through a backing material as the backing material is fed along a longitudinal path by tufting action of said needles in a tufting zone, and loopers on the other side of said backing material for catching said loops in said tufting zone and temporarily holding them, so that successive tufts of a prescribed pile height are produced in said backing material as said needles are reciprocated, the improvement comprising:

(a) a transversely disposed bedrail on said frame and over which said backing material is fed for establishing the pile height for said tufts produced in said backing material, said bedrail being movable in said frame along a prescribed path of movement for changing the position of a transverse portion of said backing material with respect to said needles for thereby changing the pile height for tufts thereafter sewn by said needles in said backing material;

(b) a reversible motor mounted on said frame;

(c) a drive train between said motor and said bedrail, by which said bedrail is moved along its prescribed path, in one direction or the other for moving a portion of said backing material in said tufting zone toward said needles upon rotation of said motor in one direction, and for moving said portion of said backing material away from said needles upon rotation of said motor in the other direction;

(d) a sensor connected to said bedrail for progressively detecting the positions of said bedrail in said path of movement;

(e) control means responsive to said sensor for controlling the direction and extent to which said motor moves said bedrail;

wherein said sensor is a linear transducer for detecting the height of said bedrail and wherein said transducer includes a rod having opposed end portions, one end portion being connected to said bedrail and a sensing element connected to said frame and movably receiving the other end portion of said rod.

10. The tufting machine defined in claim 6 wherein said sensor provides a feed back to said computer for ascertaining when said bedrail has arrived at the position prescribed by said computer so that said computer directs said motor to stop.

11. The tufting machine defined in claim 10 including brakes for automatically arresting movement of said bedrail when said motor is directed to stop.

12. A tufting machine having a frame, a main drive shaft on said frame for reciprocating a needle bar carrying a plurality of transversely disbursed needles for successively inserting yarns carried by said needles in successive transverse portions through a backing material as the backing material is fed along a longitudinal path by tufting action of said needles in a tufting zone, and loopers on the other side of said backing material for catching said loops in said tufting zone and temporarily holding them, so that successive tufts of a prescribed pile height are produced in said backing material as said needles are reciprocated, the improvement comprising:

(a) a transversely disposed bedrail on said frame and over which said backing material is fed for establishing the pile height for said tufts produced in said backing material, said bedrail being movable in said frame along a prescribed path of movement for changing the position of a transverse portion of said backing material with respect to said needles for thereby changing the pile height for tufts thereafter sewn by said needles in said backing material;

(b) a reversible motor mounted on said frame;

(c) a drive train between said motor and said bedrail, by which said bedrail is moved along its prescribed path, in one direction or the other for moving a portion of said backing material in said tufting zone toward said needles upon rotation of said motor in one direction, and for moving said portion of said backing material away from said needles upon rotation of said motor in the other direction;

(d) a sensor connected to said bedrail for progressively detecting the positions of said bedrail in said path of movement;

(e) control means responsive to said sensor for controlling the direction and extent to which said motor moves said bedrail;

wherein said control means includes a computer for dictating to said motor the extent to which said motor is to change the position of said bedrail, said sensor outputs analog signals, and said tufting machine further includes an analog-to-digital converter for receiving analog signals from said sensor, for converting said signals into digital signals, for feeding said digital signals to said computer.

13. A tufting machine having a frame, a main drive shaft on said frame for reciprocating a needle bar carrying a plurality of transversely disbursed needles for successively inserting yarns carried by said needles in successive transverse portions through a backing material as the backing material is fed along a longitudinal path by tufting action of said needles in a tufting zone, and loopers on the other side of said backing material for catching said loops in said tufting zone and temporarily holding them, so that successive tufts of a prescribed pile height are produced in said backing material as said needles are reciprocated, the improvement comprising:

(a) a transversely disposed bedrail on said frame and over which said backing material is fed for establishing the pile height for said tufts produced in said backing material, said bedrail being movable in said frame along a prescribed path of movement for changing the position of a transverse portion of said backing material with respect to said needles for thereby changing the pile height for tufts thereafter sewn by said needles in said backing material;

(b) a reversible motor mounted on said frame;

(c) a drive train between said motor and said bedrail, by which said bedrail is moved along its prescribed path, in one direction or the other for moving a portion of said backing material in said tufting zone toward said needles upon rotation of said motor in one direction, and for moving said portion of said backing material away from said needles upon rotation of said motor in the other direction;

(d) a sensor connected to said bedrail for progressively detecting the positions of said bedrail in said path of movement; and (e) control means responsive to said sensor for controlling the direction and extent to which said motor moves said bedrail;

wherein said tufting machine further includes a yarn feed mechanism for feeding said yarns to said needles, said yarn feed mechanism having a yarn feed motor controlling the amount of yarn fed and said control means including a computer controlling the rotation of said yarn feed motor, said computer receiving signals from said sensor and altering the speed of said yarn feed motor according to a prescribed program and also alternately controlling the yarn feed motor thereby for feeding an excess of yarns in prescribed increments to said needles and said reversible motor to raise said bedrail after each increment of excess amount of yarns is fed.

14. A tufting machine having a plurality of tufting needles and a frame, comprising:

a bedrail which is moveable for varying a first distance between said needles and said bedrail, said first distance affecting a pile height of tufts produced by said tufting machine;

means for moving said bedrail to vary said distance;

sensing means, attached at a fixed location relative to said frame and attached to said bedrail, for detecting a second distance between said fixed location and said bedrail and for generating an information signal; and processing means for receiving said information signal and for controlling said moving means so that said first distance equals a desired distance between said bedrail and said needles.

15. The tufting machine as set forth in claim 14, wherein said sensing means is attached to said frame and said second distance is between said frame and said bedrail.

16. The tufting machine as set forth in claim 14, wherein said moving means comprises at least one ball screw jack for raising or lowering said bedrail.

17. The tufting machine as set forth in claim 14, further comprising means for locking said bedrail in place after said second distance has been adjusted to equal said desired distance.

18. The tufting machine as set forth in claim 17, wherein said locking means comprises a hydraulic clamp.

19. The tufting machine as set forth in claim 14, wherein said desired distance is an input to said processing means.

20. The tufting machine as set forth in claim 14, wherein said desired distance is determined by said processing means.

21. A tufting machine having a plurality of tufting needles and a frame, comprising:

a bedrail which is moveable for varying a first distance between said needles and said bedrail, said first distance affecting a pile height of tufts produced by said tufting machine;

means for moving said bedrail to vary said distance;

sensing means, attached at a fixed location relative to said frame, for detecting a second distance between said sensing means and said bedrail and for generating an information signal; and processing means for receiving said information signal and for controlling said moving means so that said first distance equals a desired distance between bedrail and said needles;

wherein said sensing means comprises a linear transducer having a transducer rod with one end of said transducer rod being attached to said bedrail.

22. The tufting machine as set forth in claim 21, wherein said one end of said transducer rod is attached to a bracket which is attached to a top surface of said bedrail.

23. A tufting machine having a plurality of tufting needles and a frame, comprising:

a bedrail which is moveable for varying a first distance between said needles and said bedrail, said first distance affecting a pile height of tufts produced by said tufting machine;

means for moving said bedrail to vary said distance;

sensing means, attached at a fixed location relative to said frame, for detecting a second distance between said sensing means and said bedrail and for generating an information signal; and processing means for receiving said information signal and for controlling said moving means so that said first distance equals a desired distance between bedrail and said needles;

said tufting machine further comprising means for adjusting a rate of yarn fed to said needles wherein said processing means controls said adjusting means to alter said rate at which said yarn is fed when said first distance is greater than said desired distance.

24. The tufting machine as set forth in claim 23, wherein said processing means controls said moving means to raise said bedrail a fraction of a difference between said first distance and said desired distance and then controls said adjusting means to alter said rate at which said yarn is fed according to a current position of said bedrail.

* * * * *